US005542606A

United States Patent [19]

Kadyrov et al.

[11] Patent Number: 5,542,606

[45] Date of Patent: Aug. 6, 1996

[54] GAS DETONATION SPRAYING APPARATUS

[75] Inventors: Ernest Kadyrov, Madison, Wis.; Valery Kadyrov, Kiev, Ukraine

[73] Assignee: Demeton USA, Inc., Garden City Park, N.Y.

[21] Appl. No.: 261,398

[22] Filed: Jun. 17, 1994

[51] Int. Cl.[6] ..... B05B 1/24

[52] U.S. Cl. ..... 239/81

[58] Field of Search ..... 239/79–81, 553.3, 239/590.3, 590.5, 553.5; 231/346, 362, 22

[56] References Cited

U.S. PATENT DOCUMENTS

| | | | |
|---|---|---|---|
| 804,002 | 10/1903 | Fouche | 431/346 |
| 1,032,071 | 7/1912 | LeChazlier | 431/346 |
| 1,439,861 | 12/1922 | Brown et al. | 431/346 X |
| 1,595,382 | 8/1926 | Coberly | 431/346 |
| 2,510,143 | 6/1950 | Sandora et al. | 239/79 |
| 2,618,322 | 11/1952 | Confa et al. | 431/346 X |
| 2,685,921 | 8/1954 | Robinson | 431/346 X |
| 3,773,259 | 11/1973 | Zverev | 239/81 |
| 4,004,735 | 1/1977 | Zverev et al. | 239/79 |

*Primary Examiner*—Kevin P. Weldon
*Attorney, Agent, or Firm*—Galgano & Burke

[57] ABSTRACT

A gas detonation sprayer includes a barrel with a three-part combustion chamber and a gas distributor which is fluidly coupled to the first part of the combustion chamber. The gas distributor includes passages through which fuel gas and oxygen pass and are mixed. The first part of the combustion chamber is annular and includes a spark plug. The second part is cylindrical and has a plurality of peripheral channels which fluidly communicate with the first part. The third part is cylindrical and is fluidly coupled to the second part, and to the proximal end of the main barrel. The combustion chamber and the main barrel are housed in a casing which includes water cooling passages. A powder feeding tube passes axially through the first and second parts of the combustion chamber and terminates inside the third part. A first embodiment of the gas distributor includes two narrow annular passageways which are fluidly coupled to each other by an axial opening and to an axial outlet. Fuel gas is mixed in one of the annular passageway and oxygen is injected into the other passageway. Mixed fuel gas and oxygen exits through the axial outlet to the first part of the combustion chamber. A second embodiment of the gas distributor has separate narrow diameter passages for fuel gas and oxygen. The dimensions of the passages are chosen according to a hydrodynamic Péclet criterion so that detonation wave damping is effected to prevent backfire.

18 Claims, 4 Drawing Sheets

GAS DETONATION SPRAYING APPARATUS

BACKGROUND OF THE INVENTION

1. Field of the Invention

The invention relates to a gas detonation spraying apparatus. More particularly, the invention relates to a spraying apparatus which uses an explosive mixture of gases to propel a powder material against a surface.

2. State of the Art

Gas detonation spraying devices are well known in the art. They are typically used to apply coatings to machine parts. However, they may also be used for grinding powder materials or for cleaning or heating surfaces. They may also be used for welding or perforating non-metallic materials. In addition, they can be used to obtain powders having new physical properties or for producing structural changes in the surface layer of a material. These apparatus generally include a propulsion barrel and a combustion chamber. A mixture of combustible gases is introduced into the combustion chamber and a powder is introduced into the propulsion barrel. When the gases are detonated in the combustion chamber, the detonation wave is directed into the propulsion barrel and propels the powder through the barrel to exit the barrel as a spray. The process is repeated at intervals to produce repeated bursts of powder spray.

Gas detonation spraying devices present several engineering challenges in order to assure efficiency while maintaining safety. While a mixture of oxygen and acetylene produces a powerful detonation wave, acetylene is very dangerous. It is possible for acetylene m detonate even in the absence of oxygen. Moreover, acetylene is relatively expensive. It has therefore been known to use less combustible gases such as natural gas, proparte, butane, or a mixture of proparte and butane. These gases are safer and less expensive than acetylene. However, they are more difficult to detonate. Sprayers which use these less combustible gases typically include special devices to accelerate the gas mixture from slow combustion to detonation. These special devices dramatically increase the overall dimensions of the sprayer and also lower its capacity. Since it takes more time to detonate the gas mixture, the firing frequency of the sprayer is limited. In addition, the proportions of gas, oxygen, and powder must be strictly controlled within narrow tolerances in order for the sprayer to operate with acceptable efficiency.

Another important aspect of gas detonation spraying devices is that they can backfire. Backfiring is typically prevented by intermittently injecting nitrogen into the combustion chamber. This requires the fuel supply to be injected intermittently as well. The intermittent injection of nitrogen and fuel requires the constant opening and closing of valves which complicates the device and makes it more prone to failure. The firing frequency is also consequently limited. Moreover, the presence of nitrogen in the combustion chamber reduces the velocity of the detonation wave which has a negative affect on the quality of sprayed coatings.

A typical gas detonation spraying device is disclosed in U.S. Pat. No. 4,669,658 to Nevgod et al., the complete disclosure of which is incorporated herein by reference. The device disclosed by Nevgod et al. includes a main barrel having a combustion chamber with a spark plug and a gas supply system which includes a gas heater. A main pipe is provided at one end of the barrel and the main pipe houses the spark plug. Annular grooves in the main pipe and in the barrel enhance efficient heat transfer between the walls of the barrel and the entering gases. Gases are heated to a temperature approximating self-ignition during a first operating cycle and thereafter are ignited more easily. A buffer unit having spiral gas conduits is provided upstream of the gas heater to prevent backfire. However, the mount of gas fed into the apparatus is limited by the diameters of the gas heater. Thus, the stable operation of the device is limited to a specific gas feeding rate and thus the proportion of gases mixed. Moreover, the gas heater and the buffer are complicated and expensive to construct.

SUMMARY OF THE INVENTION

It is therefore an object of the invention to provide a gas detonation spraying apparatus which is safe but efficient.

It is also an object of the invention to provide a gas detonation spraying apparatus which uses a proparte-butane-oxygen combustion gas mixture.

It is another object of the invention to provide a gas detonation spraying apparatus which avoids the use of nitrogen in the combustion chamber.

It is still another object of the invention to provide a gas detonation spraying apparatus in which the combustion gas mixture is continuously supplied to the combustion chamber.

It is also an object of the invention to provide a gas detonation spraying apparatus which avoids the use of intermittently operated valves.

It is another object of the invention to provide a gas detonation spraying apparatus which has a high firing frequency.

It is still another object of the invention to provide a gas detonation spraying apparatus which makes efficient use of powder.

It is also an object of the invention to provide a gas detonation spraying apparatus which has few mechanically moving parts.

It is another object of the invention to provide a gas detonation spraying apparatus which does not require preheating of the combustion gas mixture.

It is still another object of the invention to provide a gas detonation spraying apparatus which is operable over a broad range of gas flow rates and gas mixture proportions.

In accord with these objects which will be discussed in detail below, the gas detonation spraying apparatus of the present invention includes barrel with a three part combustion chamber and a gas distributor which is fluidly coupled to the first part of the combustion chamber. The gas distributor includes a plurality of passages through which fuel gas and oxygen pass and are mixed. The first part of the combustion chamber is annular and includes a spark plug. The second part of the combustion chamber is cylindrical and has a plurality of peripheral channels which fluidly communicate with the first part of the combustion chamber. The third part of the combustion chamber is cylindrical and is fluidly coupled to the second part of the combustion chamber and to the proximal end of the main barrel. The combustion chamber and the main barrel are housed in a casing which includes water cooling passages. A powder feeding tube passes axially through the first and second parts of the combustion chamber and terminates inside the third part of the combustion chamber.

A first embodiment of the gas distributor includes two narrow annular passageways which are fluidly coupled to each other by an axial opening and to an axial outlet. Fuel gas is mixed in one of the annular passages and oxygen is injected into the other annular passageway. A fuel gas and oxygen mixture exits through the axial outlet to the first part of the combustion chamber. The dimensions of the annular passages are chosen according to a hydrodynamic Péclet criterion so that the volume and velocity of the gases exiting the passages into the combustion chamber is optimized and detonation wave damping is effected to prevent backfire.

A second embodiment of the gas distributor has separate narrow diameter passages for fuel gas and oxygen. The diameters of the passages are chosen according to a hydrodynamic Péclet criterion so that the volume and velocity of the gases exiting the passages into the combustion chamber is optimized and detonation wave damping is effected to prevent backfire.

The provided apparatus permits reliable operation with a variety of gas flow rates and gas mixture proportions. In addition, the apparatus can be operated with a continuous gas flow. Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
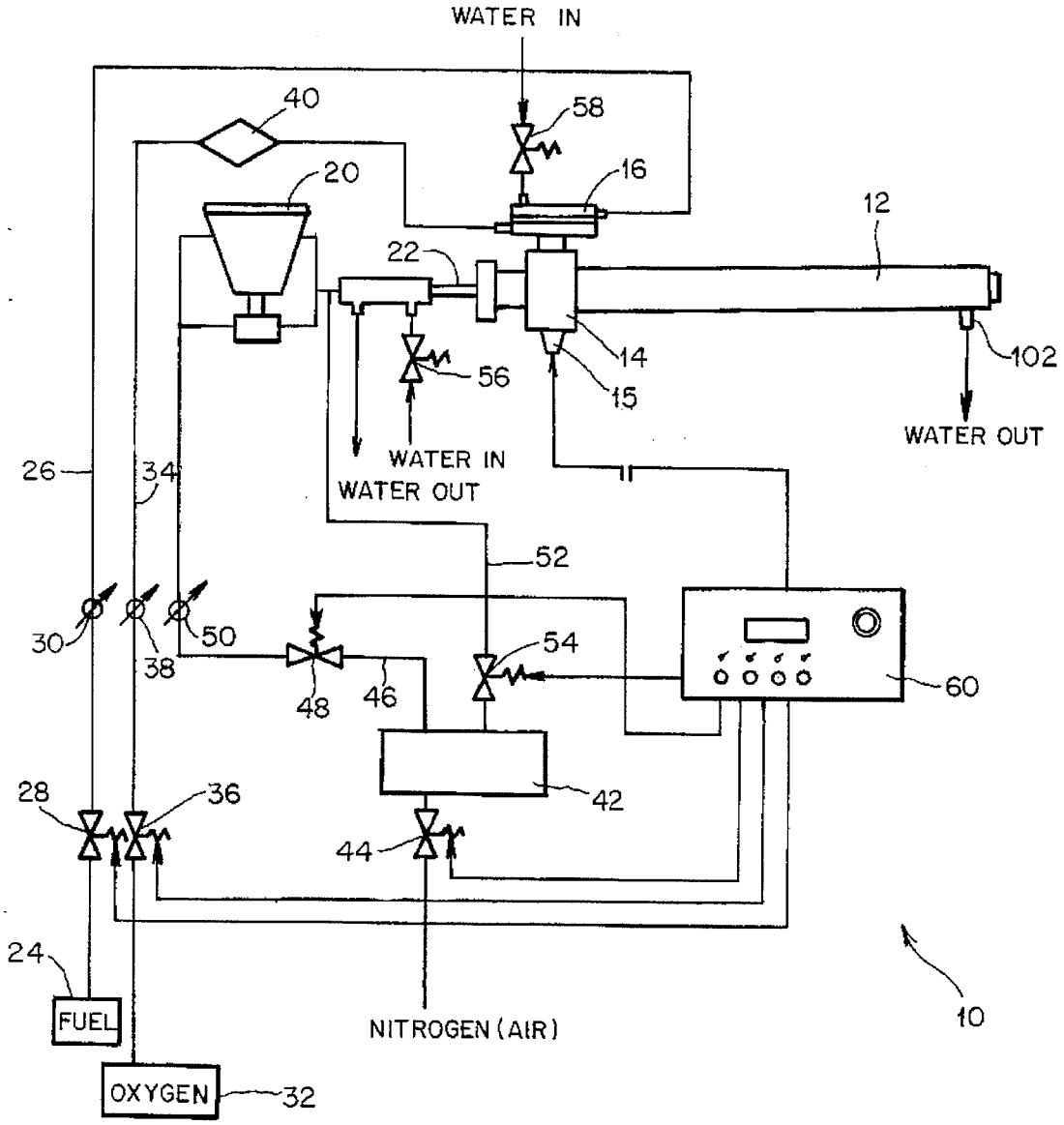
FIG. 1 is a schematic view of the gas detonation spraying apparatus according to the invention.

Turning now to FIG. 1, the gas detonation spraying apparatus 10 according to the invention generally includes a water cooled main barrel 12, a combustion chamber 14 having a spark plug 15, and a gas distributor 16 which is fluidly coupled to the combustion chamber 14. A powder feeder 20 supplies powder to the combustion chamber through a powder conduit 22. The gas distributor 16 is coupled to a fuel supply 24 by a conduit 26 having an electrically operated valve 28 and a flow meter 30. The gas distributor 16 is also coupled to an oxygen supply 32 by a conduit 34 having an electrically operated valve 36, a flow meter 38 and a flame quencher 40 (a stainless steel container having a porous element). An inert gas reservoir 42 is provided with an electrically operated inlet valve 44 and a compression pump (not shown) for filling the reservoir 42 with air. The reservoir 42 supplies inert gas to the powder feeder 20 by a conduit 46 having an electrically operated valve 48 and a flow meter 50. Inert gas is also supplied by the reservoir 42 to the combustion chamber 14 through a conduit 52 having an electrically operated valve 54. The main barrel 12, the combustion chamber 14, the gas distributor 16, and the powder feeder 20 are all cooled by flowing water which is controlled by electrically operated valves 56, 58. Each of the above mentioned valves 28, 36, 44, 48, 54, 56, and 58 is electrically coupled to a central control unit 60 which is also electrically coupled to the spark plug 15.

Figure 2:
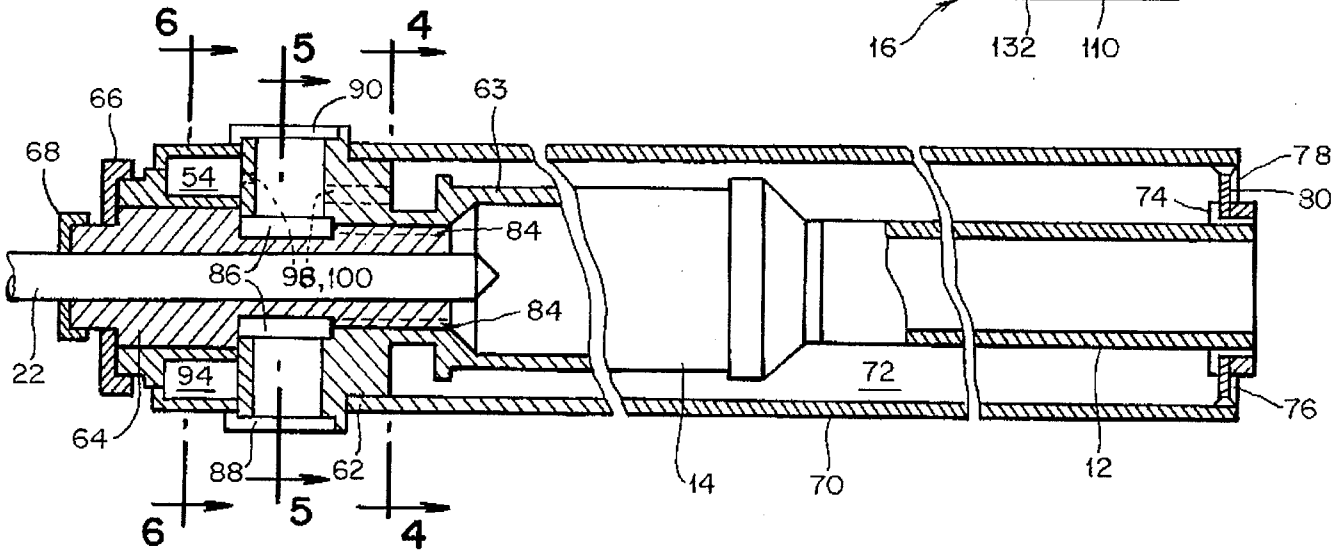
FIG. 2 is an exploded broken side elevation in partial section of the main barrel, combustion chamber, and a first embodiment of a gas distributor according to the invention.
Figure 4:
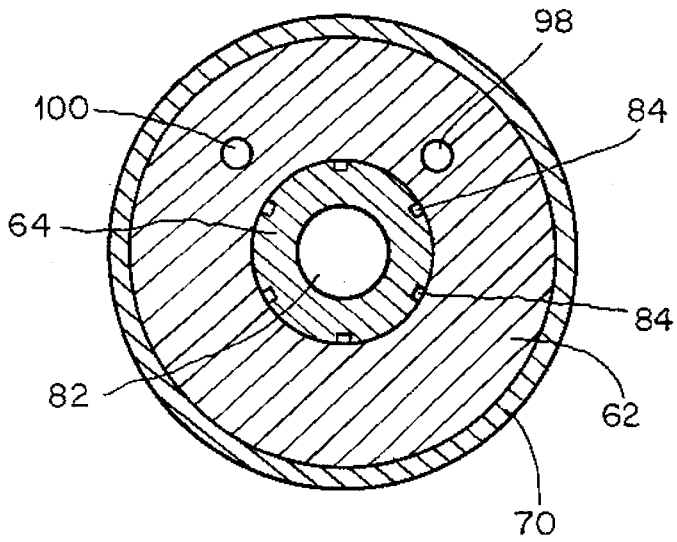
FIG. 4 is a cross section along line 4—4 in FIG. 2.
Figure 5:
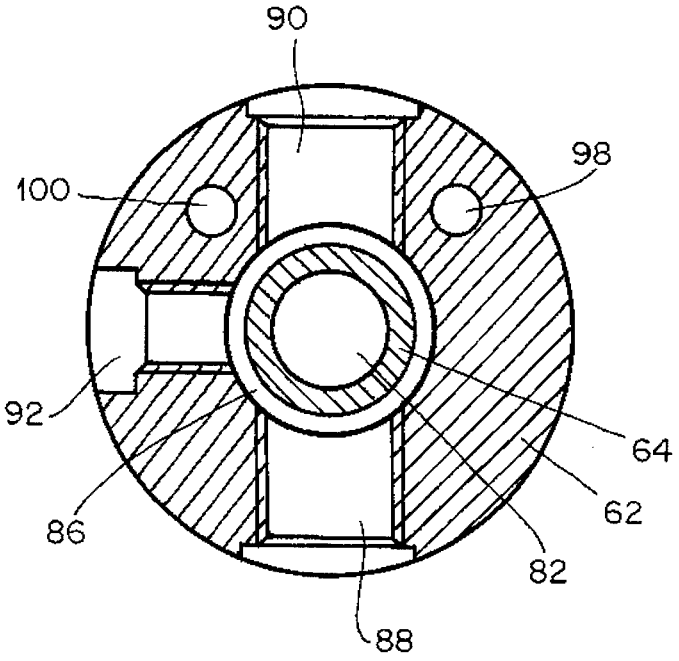
FIG. 5 is a cross section along line 5—5 in FIG. 2.
Figure 6:
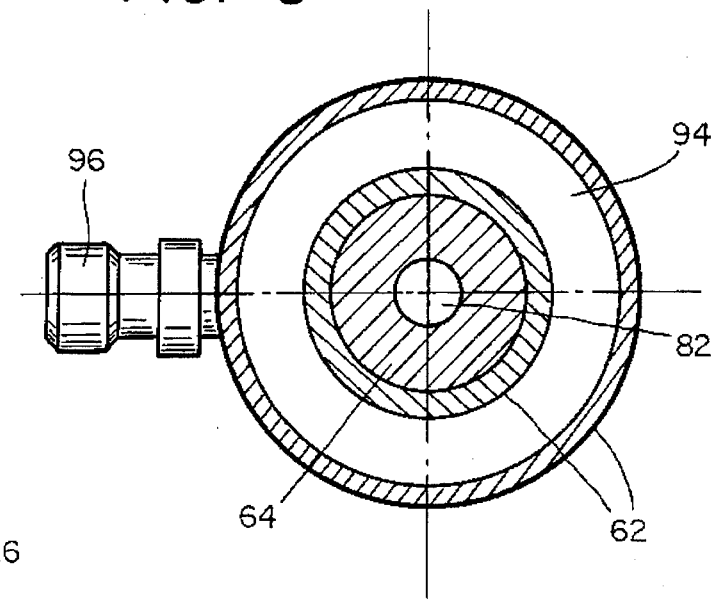
FIG. 6 is a cross section along line 6—6 in FIG. 2.

FIG. 2 shows derails of the main barrel 12, the combustion chamber 14, and a first embodiment of the gas distributor 16. The main barrel 12 is a stainless steel, carbon steel, or copper alloy tube having a proximal end which is welded to the distal end of the combustion chamber 14. The combustion chamber 14 is a substantially cylindrical member made of stainless steel, carbon steel, or copper alloy and having an increased outer diameter proximal portion 62 which is shown in greater detail in FIGS. 4 through 6 and an increased inner diameter distal portion 63. A substantially cylindrical insert 64, which is shown in greater detail in FIGS. 4 through 6, is inserted into the proximal portion 62 of the combustion chamber 14 and held in place by a threaded cap 66. The powder conduit 22 is inserted through the insert 64 and into the distal portion 63 of the combustion chamber 14. A threaded cap 68 secures the powder conduit 22 to the insert 64. The combustion chamber 14 and the main barrel 12 are housed in a water cooled casing 70 thereby providing an annular water space 72 surrounding the main barrel 12 and the distal portion 63 of the combustion chamber 14. The distal end of the main barrel 12 is provided with a threaded flange 74. A pair of disks 76 and a gasket 78 are attached to the flange 74 by a nut 80. The disks and gasket seal the annular water space 72 and allow for thermal expartsion of the main barrel 12.

Turning now to FIGS. 4 through 6 and with reference to FIG. 2, it can be seen that the insert 64 has a central bore 82 of substantially constant diameter for receiving the powder conduit 22 and a stepped outer diameter for forming various passages with the proximal portion 62 of the combustion chamber 14 which are described as follows. The distal portion of the insert 64 (FIG. 4) has a plurality of peripheral grooves 84 which form channel passages into the distal portion 63 of the combustion chamber 14. A middle portion of the insert 64 (FIG. 5) has a reduced outer diameter and forms an annular space 86 between the insert 64 and the proximal portion 62 of the combustion chamber 14. As seen in FIG. 2, the annular space 86 is fluidly coupled to the distal portion 63 of the combustion chamber by way of the peripheral grooves 84. The proximal portion of the insert 64 (FIG. 6) seals the annular space 86 in the proximal portion 62 of the combustion chamber 14. According to the invention, the number of peripheral grooves 84 may be as few as six or as many as twenty-four depending on the gas mixture used. The grooves 84 may be linear or spiral. Linear grooves are preferred for general use, but spiral grooves may provide better gas mixing.

As seen in FIGS. 2 and 5, a central part of the proximal portion 62 of the combustion chamber 14 is provided with a pair of radial inlet ports 88, 90 and a third radial ignition port 92 is provided for a spark plug (15 in FIG. 1). All of the ports 88, 90, and 92 fluidly communicate with the annular space 86 which in turn communicates with the distal portion 63 of the combustion chamber 14 by way of the above mentioned grooves 84. According to the invention, the number of radial inlet ports may be increased but the presently preferred number is two.

As seen in FIGS. 2 and 6, a proximal part of the proximal portion 62 of the combustion chamber is provided with an annular water space 94 and a water coupling 96. As seen in FIGS. 2, 4, and 5, a pair of longitudinal and radially offset water ducts 98, 100 fluidly couple the annular water space 94 with the annular water space 72. It will be appreciated, therefore, that water entering the water coupling 96 will flow through the water space 94, through the ducts 98, 100, into the water space 72 and will exit the water space 72 through a water outlet 102 which is shown in FIG. 1.

Figure 3:
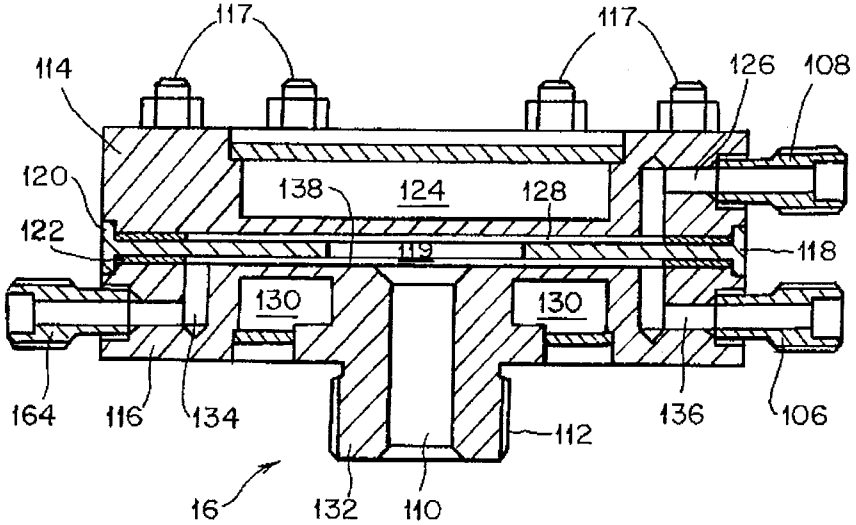
FIG. 3 is an enlarged cross sectional view of the first embodiment of the gas distributor according to the invention.

A first embodiment of the gas distributor 16 is shown in FIGS. 2 and 3. The gas distributor 16 has a pair of fuel gas inlets 104, 106 and an oxygen inlet 108. A mixed gas outlet 110 is provided with a threaded outer portion 112 which allows the gas distributor to be coupled to one of the inlet ports 88, 90 shown in FIG. 2. According to the invention, one or more gas distributors may be coupled to the combustion chamber 14 through radial inlet ports 88, 90. If only one gas distributor is used, the other port is sealed with a plug. If more than two gas distributors are used, additional radial inlet ports are provided on the combustion chamber 14. The presently preferred embodiment calls for two gas distributors, one coupled to each radial inlet port 88, 90.

Turning now to FIG. 3, the gas distributor 16 is constructed from two substantially disk shaped portions 114, 116 which are held together by bolts 117 and separated from each other by a ring 118 having a central opening 119 and two gaskets 120, 122. Disk portion 114 has a central cylindrical water cavity 124 and a radially extending oxygen inlet 108. A right angled bore 126 fluidly couples the oxygen inlet 108 to a relatively narrow annular fluid space 128 between portion 114 and ring 118. Disk portion 116 has an annular water cavity 130 which surrounds an axial stem 132 which contains the above mentioned gas outlet 110 and has a threaded outer portion 112. A pair of radially extending fuel gas inlets 104, 106 are provided, each having a corresponding right angled bore 134, 136 bringing it into fluid communication with the narrow annular fluid space 138 between the ring 118 and the portion 116. According to the invention, the gas distributor may be provided with up to twelve inlets and fight angled bores depending the fuel gases used. The embodiment shown in FIGS. 2 and 3 has two fuel inlets, one for proparte and another one for butane. From the foregoing, those skilled in the art will appreciate that as gases enter through the radial inlets 104, 106, 108 they are directed by the right angled bores 126, 134, 136 into the annular spaces 128, 138 and swift around to the central opening 119 in the ring 118 where they are mixed together and are forced out of the gas distributor through the outlet 110. The narrow dimensions of the annular spaces 128, 138 and the right angled bores effectively prevents backfire. According to the invention, the right angled bores may be angled anywhere from 45–135 degrees. The thickness of the annular space is preferably smaller than a critical dimension which is calculated according to a hydrodynamic Péclet criterion which is discussed in detail below. The gas distributor described with reference to FIGS. 2 and 3 is most suitable for use at relatively high operating frequencies. A second embodiment of a gas distributor which is more suitable for use at lower operating frequencies is described below.

Figure 7:
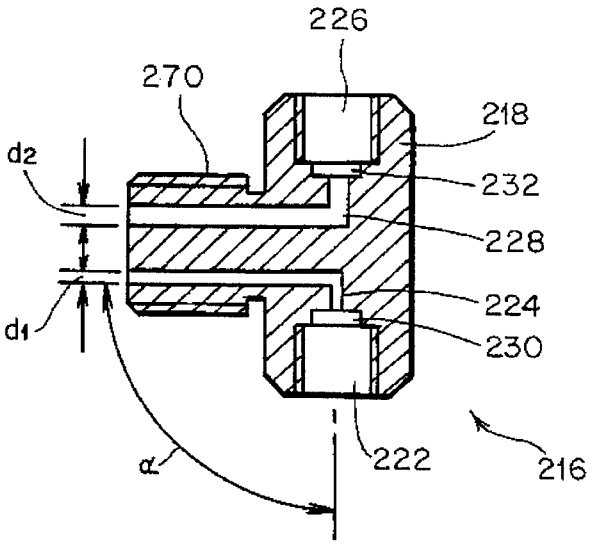
FIG. 7 is a cross sectional view of a second embodiment of a gas distributor according to the invention.
Figure 8:
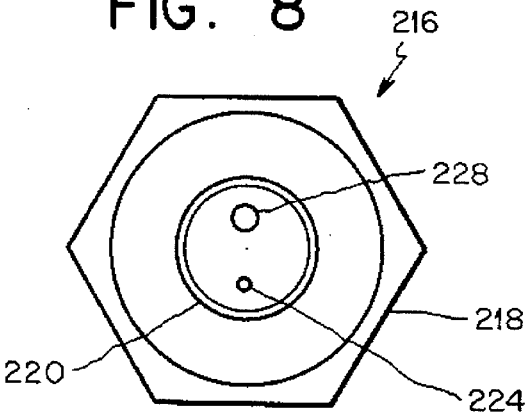
FIG. 8 is a bottom plan view of the gas distributor of FIG. 7.

FIGS. 7 and 8 describe a second embodiment of a gas distributor 216. The gas distributor 216 is a substantially hexagonal disk having a threaded axial stem 220 which fits the radial inlet bores 88, 90 in the combustion chamber shown in FIG. 2. A radial oxygen inlet 222 in the disk 218 is fluidly coupled to a right angle bore 224 which exits at the end of the stem 220. A radial fuel gas inlet 226 is similarly fluidly coupled to a fight angle bore 228 which exits at the end of the stem 220. The diameters $d_1$ and $d_2$ of the bores 224, 228 are preferably between 0.02 and 0.2 times the diameter of the main barrel 12 shown in FIG. 2. In any case, these diameters are each less than a critical diameter d which is calculated according to a hydrodynamic Péclet criterion:

$$d=PeC_pRT_1/(v\lambda P_1)$$

where:

Pe is the Péclet constant for a particular gas, $C_p$ is the specific heat of the gas mixture, R is the universal gas constant, $T_1$ is the gas temperature, v is the velocity of the detonation wave, λ is the coefficient of friction at the walls of the chamber (typically 0.2), and $P_1$ is the initial pressure of the gas mixture.

The inlet 222 is coupled to the bore 224 through cylindrical duct 230 which has a diameter two to three times the diameter of the bore 224. Similarly, the inlet 226 is coupled to the bore 228 through cylindrical duct 232 which has a diameter two to three times the diameter of the bore 228. The bores 224, 228 are shown as right angle bores, i.e. where the angle a shown in FIG. 7 is 90°. According to the invention, this angle can be anywhere between 45–135 degrees. Also according to the invention, the length of the bore 224 between the duct 230 and the place where it bends (in this case 90°) is preferably between 0.1 and 0.2 times the diameter of the main barrel 12 shown in FIG. 2. The length of the bore 224 from the place where it bends (in this case 90°) to the place where it exits the stem 220 is preferably between 0.4 and 1.2 times the diameter of the main barrel 12 shown in FIG. 2. The length of the bore 228 is similarly proportioned. The dimensions of the bores 224 and 226 functionally correspond to the dimensions of the narrow annular spaces 128, 138 in the gas distributor of FIG. 3. The dimensions of the ducts 230, 232 functionally correspond to the bores 126, 134, 136 in the gas distributor of FIG. 3.

The apparatus operates as follows: Prior to starting the apparatus the water valves 56, 58 (FIG. 1) are opened which makes water flow through the water 94, 72, 124, and 130 (FIG. 2). After the water is flowing, the gas valve 44 turns on and nitrogen gas (air) is pumped into the gas reservoir 42. Then the valves 28 and 36 are opened and the ignition voltage is periodically supplied to the spark plug 15 to reproduce a spark in the annulus 86 (FIGS. 2 and 5) of the combustion chamber 14 with the frequency of 2–15 Hertz. Oxygen and fuel propagate into the inner space of a gas distributor 16 or 216 and into the annulus 86 of the combustion chamber 14. After filling the annulus 86 of a combustion chamber 14, the combustible mixture penetrates through the grooves 84 into the distal portion 63 of the combustion chamber. The gas ignition occurs in the annulus 86, propagates further into the distal portion 63 of the combustion chamber and produces a gas detonation there. Two to ten seconds after starting the detonation in the combustion chamber, valve 54 (FIG. 1) is opened allowing the nitrogen (air) to flow through the powder feeding conduit 22 and purge the barrel 12. This initial stage lasts thirty to two hundred seconds during which the detonations quickly heat up the insert 64, the combustion chamber 14, and the gas channels in the gas distributor 16 or 216. After the gas explosion in the distal portion 63 of the combustion chamber, the detonation wave tends to propagate backwards into the annulus 86, the gas distributor 16 or 216, and to the gas supplies 24, 32. This propagation and the resultant backfiring is prevented by the narrow bores 224, 228 in the gas distributor 216 (FIG. 7) or narrow spaces 128, 138 and bores 126, 134, 136 in the gas distributor 16 (FIG. 2).

The temperature of the detonation wave rapidly decreases as the wave enters the narrow bores and spaces and the detonation wave disappears while passing the rams in the bores. The valve 54 is then closed and valve 48 is opened which allows the nitrogen (air) to flow through the powder feeder 20 and to carry powder particles into the distal portion 63 of the combustion chamber 14 where they encounter the detonation wave and are carried through the barrel 12 to impact a substrate. After the spraying is complete the valve 48 is closed and the valve 54 is opened, the spark plug voltage is shut off. The apparatus 48 purged for one to two minutes by the flowing nitrogen gas and continues to be cooled by water.

According to the invention, the maintenance of high temperatures on surfaces contacting the detonation products also precludes condensation of water vapors contained in the detonation products, thereby preventing the powder from sticking to the walls of the barrel 12 and from jamming the powder conduit 21.

Having a temperature of 20° C. at the inlet of water reliably protects the gas distributor against backflash.

Gas heating is concurrent with constant rise of temperature of the barrel 12. The temperature difference of the between the casing 70 and the barrel 12 results in the elongation of the barrel 12 relative to the casing 70. According to the invention the gasket 78 and the disks 76 compensate for elongation of the barrel 12 relative to the casing 70. The present invention eliminates mechanically moving parts in the apparatus, the use of neutral gas as a buffer to prevent backfiring during the detonation and simplifies the design of the system making the equipment more reliable and cost-efficient. The present invention allows explosion hazards to be considerably reduced. Additionally, the present invention makes it possible to extend the production capabilities by using available cheap combustible gases such as proparte-butane, which combined with relatively simple and cheap equipment, makes them readily available for various branches of the national economy both in manufacturing new machine parts and in reconditioning worn-out ones.

There have been described and illustrated herein several embodiments of a gas detonation spraying apparatus. While particular embodiments of the invention have been described, it is not intended that the invention be limited thereto, as it is intended that the invention be as broad in scope as the art will allow and that the specification be read likewise. Thus, while particular valves and conduit arrangements have been disclosed, it will be appreciated that other arrangements could be utilized. Also, while two embodiments of gas distributor have been shown for use with the disclosed combustion chamber, it will be recognized that other types of gas distributors could be used with similar results obtained. Moreover, while particular configurations have been disclosed in reference to the combustion chamber it will be appreciated that other configurations could be used in conjunction with one of the disclosed gas distributors. It will therefore be appreciated by those skilled in the art that yet other modifications could be made to the provided invention without deviating from its spirit and scope as so claimed.

We claim:

1. A gas detonation spraying apparatus comprising:

a) a main barrel having a proximal end;

b) a combustion chamber having an annular part, a first cylindrical part with a plurality of peripheral passages, said passages being sized and dimensioned to dampen a gas detonation wave and minimize backfiring of the same during operation of said apparatus, and a second cylindrical part which is coupled to said proximal end of said main barrel, said annular part and said second cylindrical part being fluidly coupled to each other by said peripheral passages;

c) a gas distributor having an oxygen inlet, a fuel gas inlet, and an outlet, said outlet being fluidly coupled to said annular part of said combustion chamber;

d) an ignition device located within said combustion chamber in communication with said annular part of said combustion chamber; and e) a powder feeding conduit having an outlet disposed within said second cylindrical part.

2. A gas detonation spraying apparatus according to claim 1, wherein:

said gas distributor has a first annular passage, a second annular passage, and an axial passage fluidly coupling said first and second annular passages, said oxygen inlet being fluidly coupled to said first annular passage, said fuel gas inlet being fluidly coupled to said second annular passage, and said outlet being fluidly coupled to said axial passage.

3. A gas detonation spraying apparatus according to claim 2, wherein:

said oxygen inlet is fluidly coupled to said first annular passage through a first duct having a bend of 45–135 degrees, and said fuel gas inlet is fluidly coupled to said second annular passage through a second duct having a bend of 45–135 degrees.

4. A gas detonation spraying apparatus according to claim 2, wherein:

said first and second annular passages each have a diameter d which is approximately determined by a Pecklet criterion, said Pecklet criterion being calculated using the formula $$d=PeC_pRT_1/v\lambda P_1$$

where Pe is the Pecklet constant for a particular gas, $C_p$ is the specific heat of said gas, R is the universal gas constant, $T_1$ is the temperature of said gas, v is the velocity of said detonation wave, $\lambda$ is the coefficient of friction at the walls of said passages and $P_1$ is the initial pressure of said gas.

5. A gas detonation spraying apparatus according to claim 1, wherein:

said gas distributor has a first passage having an inlet and an outlet and a first bend between the inlet and the outlet, and a second angled passage having an inlet and an outlet and a second bend between the inlet and the outlet, said oxygen inlet being coupled to the inlet of said first passage, and said fuel gas inlet being coupled to the inlet of said second passage, the outlets of said first and second passages being the outlet of said gas distributer, and said first and second bends are 45–135 degrees.

6. A gas detonation spraying apparatus according to claim 5, wherein:

said first passage has a first diameter, said second passage has a second diameter, and said main barrel has a barrel diameter, said first and second diameters being 0.02–0.2 times the barrel diameter.

7. A gas detonation spraying apparatus according to claim 5, wherein:

said main barrel has a barrel diameter, said first passage has a length from its inlet to the first bend of 0.1–0.2 times the barrel diameter and a length from the first bend to its outlet of 0.4–1.2 times the barrel diameter, and said second passage has a length from its inlet to the second bend of 0.1–0.2 times the barrel diameter and a length from the second bend to its outlet of 0.4–1.2 times the barrel diameter.

8. A gas detonation spraying apparatus according to claim 6, wherein:

said oxygen inlet is coupled to said inlet of said first passage through a first duct having a diameter 2–3 times the first diameter, and said fuel gas inlet is coupled to said inlet of said second passage through a second duct having a diameter 2–3 times the second diameter.

9. A gas detonation spraying apparatus according to claim 1, wherein:

said combustion chamber is formed from a substantially cylindrical member having stepped inner and outer diameters and a substantially cylindrical insert having a substantially constant diameter throughbore and a stepped outer diameter, a distal portion of said insert being provided with a plurality of surface grooves which form said peripheral passages, and said powder feeding conduit extending through said substantially constant diameter throughbore.

10. A gas detonation spraying apparatus according to claim 1, wherein:

said main barrel and said combustion chamber are housed in a casing, and said casing, said combustion chamber, and said gas distributor are provided with cavities for water cooling.

11. A gas detonation spraying apparatus according to claim 2, wherein:

said first and second annular passages each have a diameter between 0.02 and 0.2 times the diameter of said main barrel.

12. A gas detonation spraying apparatus comprising:

a) a main barrel having a proximal end;

b) a combustion chamber having a cylindrical part, said cylindrical part being coupled to said proximal end of said main barrel;

c) a gas distributor having an oxygen inlet, a fuel gas inlet, and an outlet, said outlet being fluidly coupled to said combustion chamber;

d) an ignition device located within said combustion chamber; and e) a powder feeding conduit having an outlet disposed within said cylindrical part, wherein:

said gas distributor has a first annular passage, a second annular passage, and an axial passage fluidly coupling said first and second annular passages, said first and second annular passages being sized and dimensioned to dampen a gas detonation wave and minimize backfiring of the same during operation of said apparatus, and said oxygen inlet being fluidly coupled to said first annular passage, said fuel gas inlet being fluidly coupled to said second annular passage, and said outlet being fluidly coupled to said axial passage.

13. A gas detonation spraying apparatus according to claim 12, wherein:

said oxygen inlet is fluidly coupled to said first annular passage through a first duct having a bend of 45–135 degrees, and said fuel gas inlet is fluidly coupled to said second annular passage through a second duct having a bend of 45–135 degrees.

14. A gas detonation spraying apparatus according to claim 12, wherein:

said first and second annular passages each have a diameter d which is approximately determined by a Pecklet criterion, said Pecklet criterion being calculated using the formula $$d=PeC_pRT_1/v\lambda P_1$$

where Pe is the Pecklet constant for a particular gas, $C_p$ is the specific heat of said gas, R is the universal gas constant, $T_1$ is the temperature of said gas, v is the velocity of said detonation wave, $\lambda$ is the coefficient of friction at the walls of said passages and $P_1$ is the initial pressure of said gas.

15. A gas detonation spraying apparatus comprising:

a) a main barrel having a proximal end;

b) a combustion chamber having a cylindrical part, said cylindrical part coupled to said proximal end of said main barrel;

c) a gas distributor having an oxygen inlet, a fuel gas inlet, and an outlet, said outlet being fluidly coupled to said combustion chamber;

d) an ignition device located within said combustion chamber; and e) a powder feeding conduit having an outlet disposed within said cylindrical part, wherein:

said gas distributor has a first passage having an inlet and an outlet and a first bend between the inlet and the outlet, and a second passage having an inlet and an outlet and a second bend between the inlet and the outlet, said first and second annular passages being sized and dimensioned to dampen a gas detonation wave and minimize backfiring of the same during operation of said apparatus, said oxygen inlet being coupled to the inlet of said first passage, and said fuel gas inlet being coupled to the inlet of said second passage, the outlets of said first and second passages being the outlet of said gas distributor, and said first and second bends are 45–135 degrees.

16. A gas detonation spraying apparatus according to claim 15, wherein:

said first passage has a first diameter, said second passage has a second diameter, and said main barrel has a barrel diameter, said first and second diameters being 0.02–0.2 times the barrel diameter.

17. A gas detonation spraying apparatus according to claim 15, wherein:

said main barrel has a barrel diameter, said first passage has a length from its inlet to the first bend of 0.1–0.2 times the barrel diameter and a length from the first bend to its outlet of 0.4–1.2 times the barrel diameter, and said second passage has a length from its inlet to the second bend of 0.1–0.2 times the barrel diameter and a length from the second bend to its outlet of 0.4–1.2 times the barrel diameter.

18. A gas detonation spraying apparatus according to claim 16, wherein:

said oxygen inlet is coupled to said inlet of said first passage through a first duct having a diameter 2–3 times the first diameter, and said fuel gas inlet is coupled to said inlet of said second passage through a second duet having a diameter 2–3 times the second diameter.

* * * * *